United States Patent [19]

Katsumoto et al.

[11] 4,151,717

[45] May 1, 1979

[54] CATALYTIC CONVERTER APPARATUS FOR ENGINE

[75] Inventors: Takehiko Katsumoto; Yasuhiko Kiritani; Takashi Takemoto, all of Kyoto, Japan

[73] Assignee: Mitsubishi Jidosha Kogyo Kabushika Kaisha, Tokyo, Japan

[21] Appl. No.: 809,068

[22] Filed: Jun. 22, 1977

[30] Foreign Application Priority Data

Mar. 2, 1977 [JP] Japan ..... 52/23177

[51] Int. Cl.[2] ..... F01N 3/15

[52] U.S. Cl. ..... 60/302; 422/177

[58] Field of Search ..... 60/302, 299, 322; 23/288 F

[56] References Cited

U.S. PATENT DOCUMENTS

| | | | |
|---|---|---|---|
| 3,902,853 | 9/1975 | Marsee | 60/322 |
| 3,981,145 | 9/1976 | Noguchi | 60/302 |
| 3,994,130 | 11/1976 | Sakai | 60/302 |
| 4,005,576 | 2/1977 | Nohira | 60/302 |

FOREIGN PATENT DOCUMENTS

| | | | |
|---|---|---|---|
| 2559110 | 12/1976 | Fed. Rep. of Germany | 60/302 |

*Primary Examiner*—Douglas Hart

*Attorney, Agent, or Firm*—Wenderoth, Lind & Ponack

[57] ABSTRACT

A catalytic converter apparatus for reducing pollutants from an engine having a plurality of cylinders. The converter apparatus has an upper casing for mounting on the engine and branch pipes extending to the engine and through which exhaust gas discharged from the respective cylinders in the engine is led. A lower casing is connected to the upper casing for forming an exhaust manifold in cooperation with the upper casing. The lower casing has a discharge port for the exhaust gas. A catalyst casing is disposed within the exhaust manifold and has a support member extending therefrom and held between abutting surfaces of the upper and lower casings. Bolts are inserted through the casings from above the upper casing for coupling the upper and lower casings to each other and clamping the support member therebetween.

15 Claims, 10 Drawing Figures

CATALYTIC CONVERTER APPARATUS FOR ENGINE

This invention relates to a catalytic converter apparatus for cleaning the exhaust gas of an engine, especially an automobile internal combustion engine having a plurality of cylinders.

BACKGROUND OF THE INVENTION AND PRIOR ART

Heretofore, catalytic converter apparatuses for automobile engines have had many disadvantages. For example, since in general a catalyst layer is provided within a container disposed under the floor of the automobile body downstream of an exhaust pipe, said container for holding said catalyst layer has to be specially made. Furthermore, the amount of heat from the container under the floor of the body is so great that heat insulation for blocking the flow of heat to the interior of the automobile body must be provided, and thus the apparatus is costly and difficult to make.

In addition, the apparatuses of the prior art have the disadvantage that, due to the fact that the exhaust gas temperature is reduced by the time it reaches the catalyst layer because the catalyst container is positioned relatively far from the engine, the cleaning efficiency of the catalyst layer is reduced.

OBJECT AND BRIEF SUMMARY OF THE INVENTION

It is the object of the present invention to provide a catalytic converter which obviates the aforementioned disadvantages.

To this end, there is provided a catalystic converter apparatus according to the invention which comprises an upper casing mounted on an engine body and having a plurality of cylinders, branch pipes from the cylinders to the upper casing through which exhaust gas discharged from said cylinder is led, a lower casing connected to said upper casing and with said upper casing defining an exhaust manifold and having a discharge port for said exhaust gas, a catalyst casing disposed within said exhaust manifold and supported on a support member held between abutting surfaces of said upper and lower casings, and bolts inserted from said upper casing into said lower casing for coupling said upper and lower casings to each other and clamping said support member therebetween. Since the catalytic converter appartus has a catalyst casing within an exhaust manifold which is divided into two parts, the support member for supporting said catalyst casing being clamped between abutting surfaces of the parts of said exhaust manifold, and the two parts are fastened together by bolts inserted from the upper casing, the catalystic converter apparatus is very compact and easy to make.

BRIEF DESCRIPTION OF THE FIGURES

The invention will now be described in greater detail in connection with the accompanying drawings, in which.

DETAILED DESCRIPTION OF THE INVENTION

A first preferred embodiment of the present invention will be described with reference to FIGS. 1 through 7.

Figure 1:
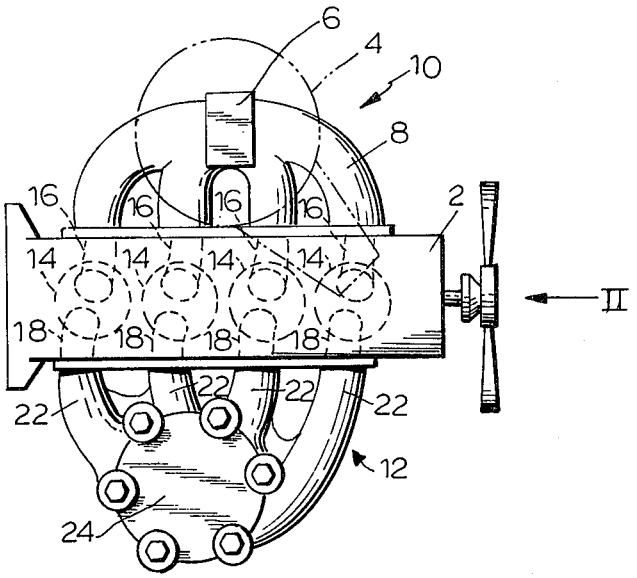
FIG. 1 is a schematic plan view showing a first preferred embodiment of the present invention in relation to an automobile engine.
Figure 2:
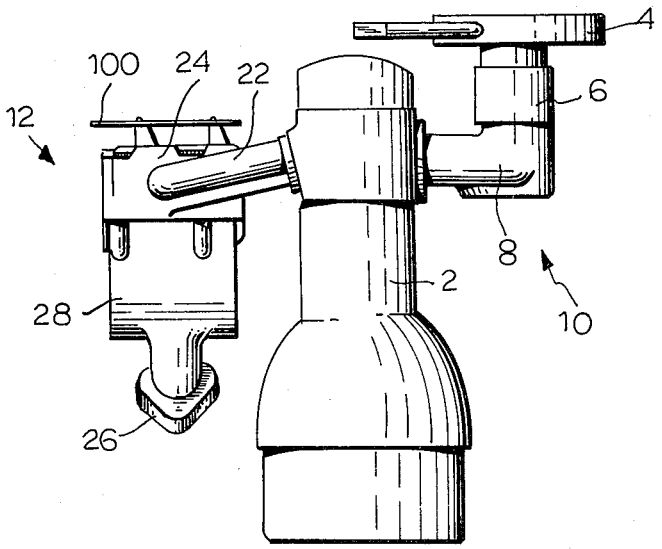
FIG. 2 is a schematic elevation view of the embodiment of FIG. 1 as viewed in the direction of arrow II in FIG. 1.
Figure 3:
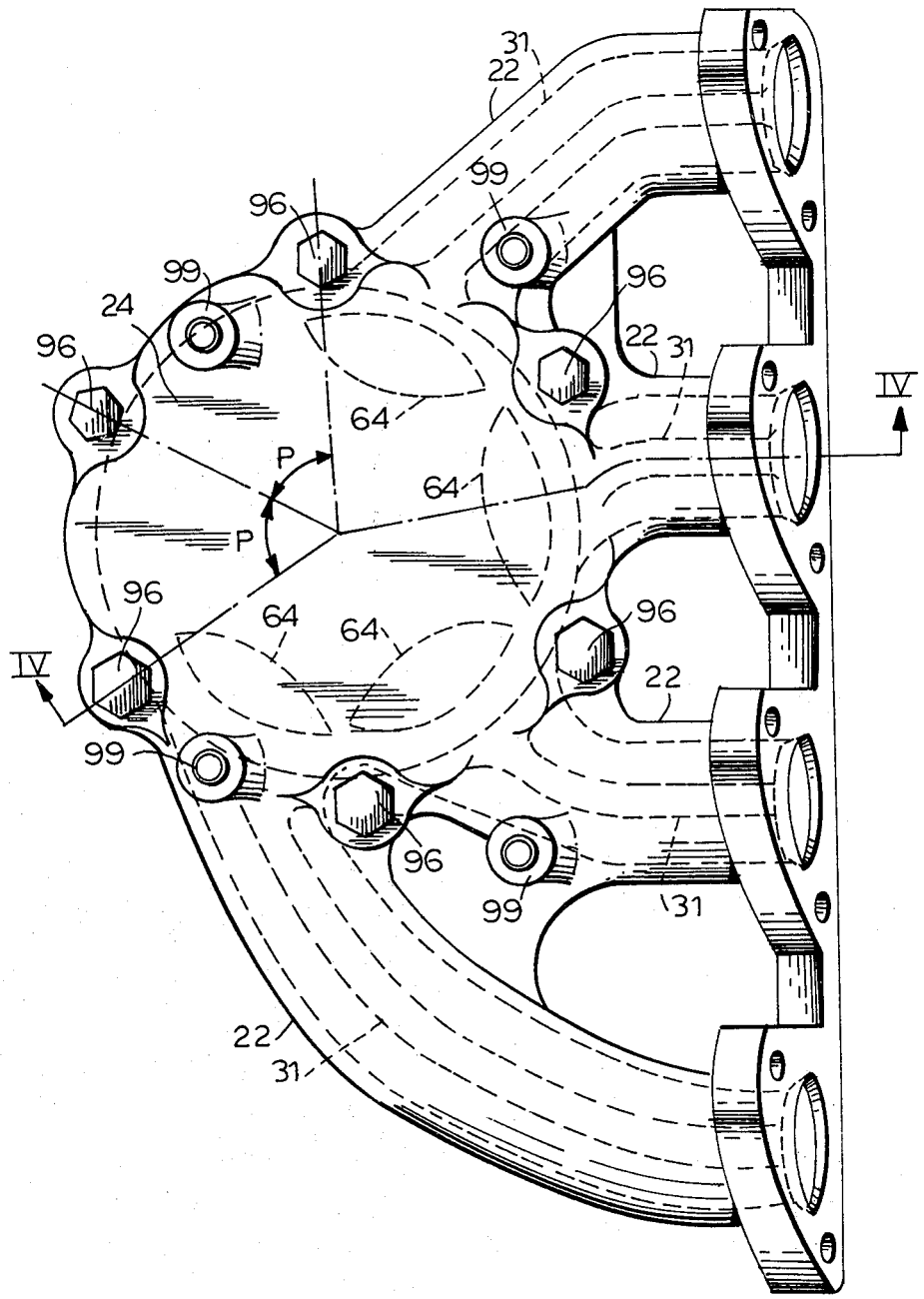
FIG. 3 is a plan view, in an enlarged scale, of an exhaust manifold according to the first preferred embodiment of the present invention.
Figure 4:
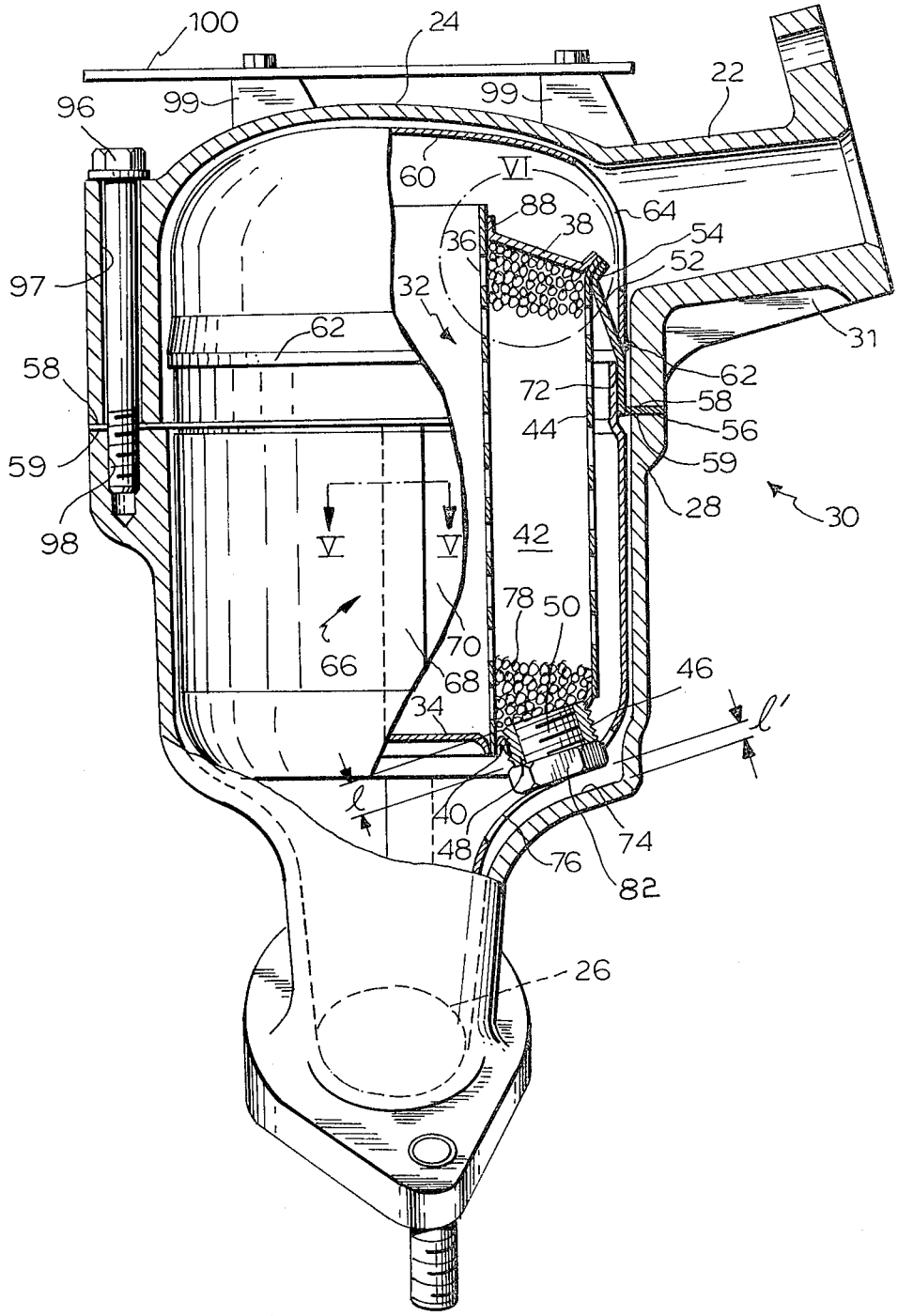
FIG. 4 is a sectional elevational view taken along line IV—IV in FIG. 3.
Figure 5:
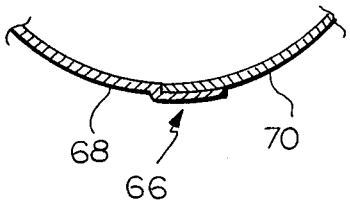
FIG. 5 is a partial sectional view taken along line V—V in FIG. 4.

An engine body 2, which is for a 4-cylinder engine, is provided with an intake system 10 including an air cleaner 4, a carburetor 6 and an intake manifold 8, and an exhaust system 12. A gaseous air-fuel mixture formed in the intake system is fed to respective cylinders 14 of the engine body 2 through intake ports 16, while exhaust gas generated by combustion of the air-fuel mixture is exhausted through exhaust ports 18 into the exhaust system 12 and is further discharged to the atomosphere. The exhaust system 12 comprises an upper casing 24 having independent branch pipes 22 thereon for conducting exhaust gas exhausted from the respective cylinders 14 to the casing 24 substantially independently of each other, and a lower casing 28 disposed beneath the upper casing 24 and having a discharge port 26 for discharging the exhaust gas therefrom. The two casing 24 and 28 together constitute an exhaust manifold 30 (FIG. 4). Ribs 31 are formed along the lower surfaces of the independent branch pipes 22. A catalyst casing 32 is disposed within the exhaust manifold 30, and it consists of a substantially cylindrical inner core 36, formed of a perforated plate and having the upper end opened and the lower end closed by a blocking plate 34, and an outer core 44 formed of a perforated plate, disposed coaxially with and spaced outwardly from said inner core and having both the upper and lower ends thereof closed by an upper blocking plate 38 and a lower blocking plate 40, respectively. The space between the inner core 36 and the outer core 44 is filled with a catalyst of, for example, pellet type to form a catalyst layer 42. A threaded sleeve 46 is welded to the lower blocking plate 40, into which a plug 48 is threaded to close a catalyst charging port 50. A support member 52 of substantially cylindrical shape has its inner peripheral edge 54 welded to the upper end portion of the outer core 44 and its outer peripheral portion shaped into a flat annular flange 56, and the flange 56 is clamped between the bottom surface 58 of the upper casing 24 and the top surface 59 of the lower casing 28 to support the catalyst casing 32 within the manifold 30.

Reference numeral 60 designates a substantially hemispherical upper heat-shielding plate that is press-worked from sheet metal, and having a lower periphery 62 welded along and to the outer circumference of the cylindrical section of the support member 52, and the upper heat-shielding plate 60 is provided with apertures 64 at the locations corresponding to the respective branch pipes 22. A lower heat-shielding plate 66 is provided with consists of a first lower heat-shielding plate half 68 and a second lower heat-shielding plate half 70, the first and second heat-shielding plate halves 68 and 70 being integrally connected along overlapped edge seams (see FIG. 5), and the upper edge of the lower heat-shielding plate 66 being welded along and to the inner surface of the cylindrical section of the support member 52. The aforementioned upper and lower heat-shielding plates 60 and 66 are supported within the exhaust gas manifold 30 together with the catalyst casing 32 by being welded to the support member 52 in the above-described manner, and are disposed along the inner wall surface 74 of the exhaust manifold 30 with a predetermined space between the wall surface 74 and the plates 60 and 66. The lower heat shielding plate 66 is provided with an aperture 76 at the location of the above-described plug 48 so that the plug 48 can be inserted or removed from the outside of the lower heat-shielding plate 66 for initially charging, replacing or supplementing the catalyst layer 42 with catalyst material 78.

The effective length l of the threaded portion of the plug 48 is selected so that even if the plug 48 should become loose due to vibration, thermal deformation, etc., the head 82 of the plug 48 will abut the inner wall surface 74 of the exhaust manifold 30 before it comes out of the sleeve 46, so that the plug 48 will not fall out into the exhaust outlet port 26. More particularly, the distance l' between the head 82 of the plug and the inner wall surface 74 of the exhaust manifold is selected so as to fulfill the relation $l' < l$.

Figure 6:
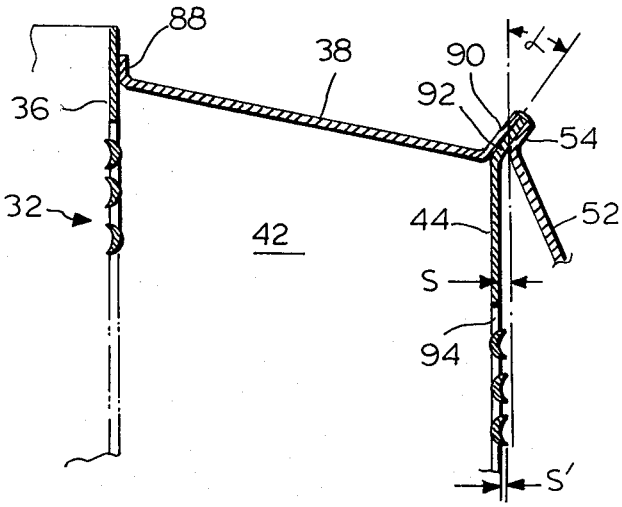
FIG. 6 is an enlarged partial sectional view of the part encircled by line VI in FIG. 4.
Figure 7:
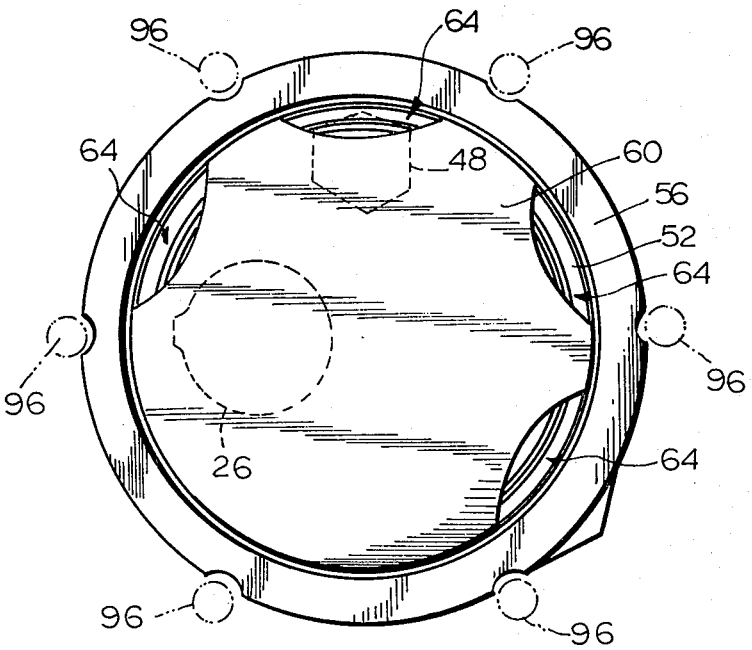
FIG. 7 is a plan view of heat-shielding plates and a support member according to the first preferred embodiment of the present invention.

The aforementioned inner core 36 and the lower blocking plate 40, the outer core 44 and the upper blocking plate 38 and lower blocking plate 40, and the outer core 44 and the inner peripheral edge 54 of the support member 52 are respectively welded to each other to form a space for accommodating the catalyst layer 42, but the inner peripheral edge of the upper blocking plate 38 is bent upwardly to form a vertical flange 88 and is supported along the outer circumference of the inner core 36 in a vertically slidable manner. In addition, as best seen in FIG. 6, the outer peripheral edge 90 of the upper blocking plate 38, the upper end 92 of the outer core 44 and the inner peripheral edge 54 of the support member 52 are deformed into a conical shape inclined at an angle $\alpha$ to the vertical, so that upon assembling the outer core 44 in the support member 52, the positioning can be effected easily. In addition, between the innermost circumference of the support member 52 and the outer circumference of the cylindrical section of the outer core 44 is left a gap S larger than the size S' of the burns produced at the time of perforating the outer core 44 to form a large number of holes 94 (see FIG. 6), so that when the catalyst casing 32 is inserted from above the support member 52 for assembling, the burns will not interfere with the invention.

Bolts 96 are inserted from above into holes 97 provided in the upper casing 24 and threadedly in threaded holes 98 provided in the lower casing 28 to connect the upper casing 24 and the lower casing 28 and thereby form an exhaust manifold 30, and between the bottom surface 58 of the upper casing 24 and the top surface 59 of the lower casing 28 is clamped the flange 56 of the support member 52 for the catalyst casing 32. No gasket is required and at the same time the catalyst casing 32 as well as the upper and lower heat-shielding plates 60 and 66 are held within the exhaust manifold 30. Here it is to be noted that the bolts 96 are disposed on the same circumference and at an equal pitch P and the arrangement is such that the branch pipes 22 open into the upper casing 24 in the intervals between the bolts 96 to simplify the machining operations and also to secure the two casings 24 and 32 uniformly along their abutting surfaces. In other words, the bolts 96 are inserted and tightened from above without interference from any part of the structure, and the exhaust manifold 30 can be assembled by fastening all the bolts 96 at one time with a bolt fastening device provided with wrench portions corresponding respectively to the bolts 96 disposed at an equal pitch along the same circumference. In the illustrated embodiment, the aforementioned pitch P is determined by dividing the above-described circumference into six equal parts, that is, $P = 60°$. Mounting seats 99 are provided on upper casing 24 for attachment to a heat cover 100.

In the catalyst converter constructed as described above, exhaust gas discharged from the respective cylinders 14 of the engine body 2 is directed into the exhaust manifold 30 through the branch pipes 22 corresponding to the respective cylinders 14 and through the apertures 64 in the upper heat-shielding plate 60 corresponding to the respective branch pipes 22. Then it passes from the inside of the inner core 36 through the catalyst layer 42 to the outside of the outer core 44. It cannot flow directly to the outside of the outer core 44 because the support member 52 welded to the upper edge 54 of the outer core 44 blocks flow in the path. Consequently the exhaust gas is cleaned by the catalyst 78 such as, for example, an oxidation catalyst, a reduction catalyst or a ternary catalyst forming the catalyst layer 42, is guided along the lower heat-shielding plate 66, and is exhausted to the atmosphere through the exhaust port 26 for the exhaust gas through an exhaust pipe and a muffler not shown. In this arrangement, the upper heat-shielding plate 60 serves to regulate the flow of the exhaust gas by means of the apertures 64, and also serves to prevent the heat of the exhaust gas from being transferred to the upper casing 24 and the temperature of the exhaust gas from falling so as to maintain the temperature of the exhaust gas at a temperature necessary for cleaning thereof, and to promote the cleaning reaction soon after starting of the engine.

Consequently, according to the present invention, since the exhaust manifold 30 can be assembled integrally with the catalyst casing 32 mounted on the support member 52 by means of the bolts 96 inserted from above the upper casing 24 forming part of the exhaust manifold 30, the catalytic converter has a simple structure and is easy to manufacture, the catalyst layer 42 is held within the exhaust manifold, and the exhaust gas discharged from the respective cylinders 14 is cleaned while being maintained at a high temperature, and therefore, a catalytic converter apparatus having a high efficiency is provided.

In addition, since the catalyst casing 32 is supported with the upper edge portion of the outer core 44 fixedly secured to the support member 52, when a temperature variation occurs the catalyst casing 32 can expand and contract with respect to the aforementioned support point serving as a reference point, and also since the inner core 36 is fixedly secured to the above-described blocking plate 34 and the lower blocking plate 40, the inner core 36 can expand and contract while being guided by the inner periphery of the upper blocking plate 38 with respect to the aforementioned support point as a reference point, so that excessively large thermal stresses will not arise in the above-described respective members and thereby generation of cracks caused by thermal stresses is prevented.

Furthermore, since the branch pipes 22 for the exhaust gas corresponding to the respective cylinders 14 are disposed independently of each other, and since the aforementioned bolts 96 are arranged at an equal pitch and the exhaust gas is fed to the exhaust manifold 30 at the intervals between these bolts 96, a catalytic converter apparatus that is very compact and light in weight and that is very strongly reinforced by ribs provided along the lower surfaces of the branch pipes 22 is obtained.

Still further, since the aforementioned support member 52 is welded to the supper portion of the outer core 44 and serves to support the catalyst casing 32 and the upper and lower heat-shielding 60 and 66 by the flange 56 clamped between the abutting surfaces of the aforementioned upper casing 24 and the lower casing 28, this support member 52 is extremely flexible so as to be able to accommodate thermal deformations, vibrations, etc., both in the axial direction and the transverse direction thereto, while it also acts as a reliable support member.

In addition, the above-described upper and lower heat-shielding plates 60 and 66 are at a predetermined clearance from the inner wall surface of the exhaust manifold 30, so that the heat-shielding effect is enhanced, and thereby thermal damage to other parts in the ambient space of the exhaust manifold 30 can be effectively prevented.

Figure 8:
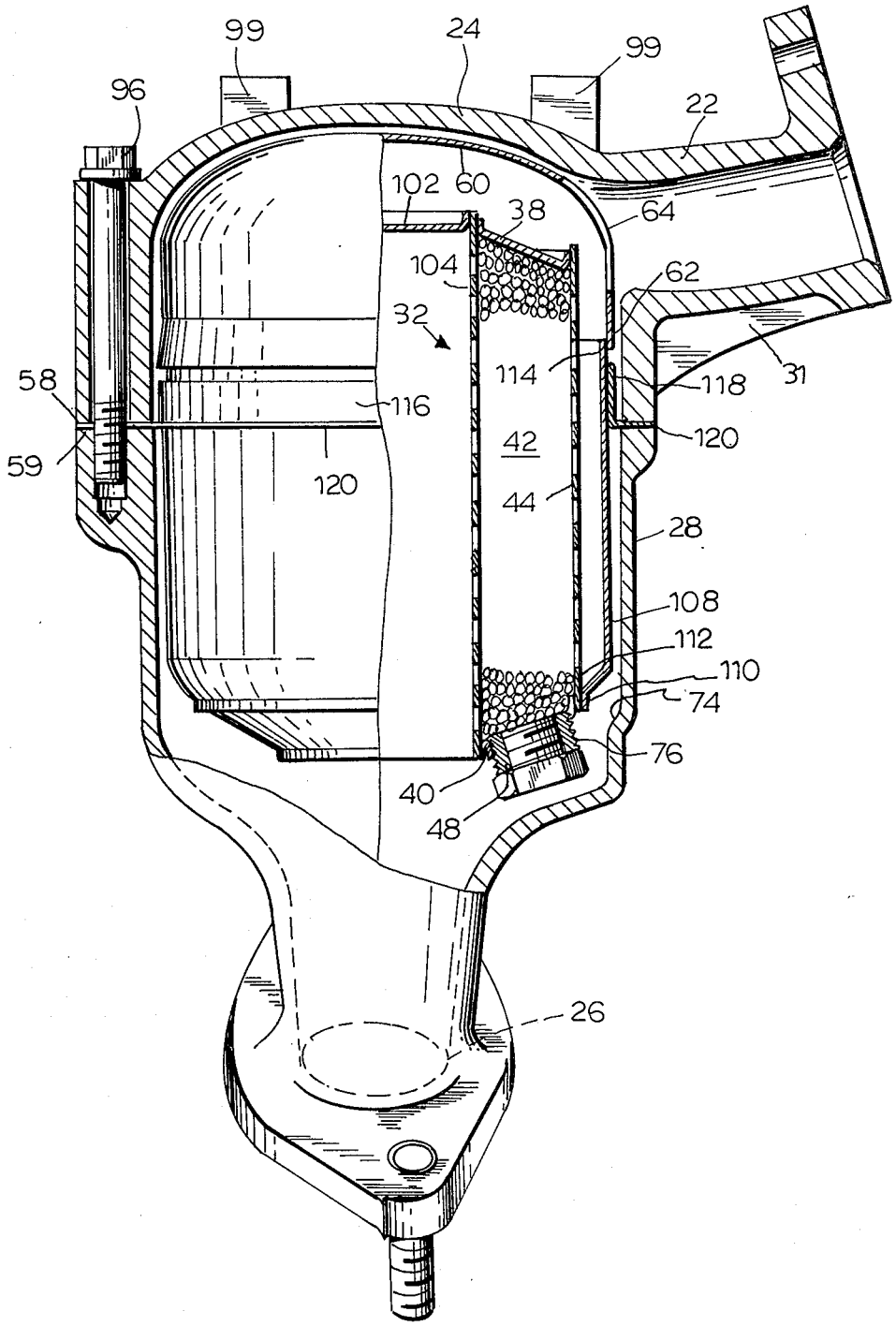
FIG. 8 is a sectional elevational view of a second preferred embodiment of the present invention.

A second preferred embodiment of the present invention is shown in FIG. 8.

Identical or substantially identical component elements to those of the above-described first preferred embodiment are designated by the same reference numerals, and a detailed description thereof will be omitted. In the above-described first preferred embodiment, the configurations of the catalyst casing 32, the upper and the lower heat-shielding plates 60 and 66 and the support member 52 are designed so that the exhaust gas is passed from the inside of the inner core to the outside of the outer core 44, whereas in the second preferred embodiment the exhaust gas is passed from the outside of the outer core to the inside of the inner core. The catalyst casing 32 is composed of a substantially cylindrical inner core 104 formed of a perforated plate and having its upper end closed by a blocking plate 102 and its lower end open, and an outer core 44 formed of a perforated plate, disposed coaxially with the inner core 104 and having both the upper and lower ends closed by the upper blocking plate 38 and the lower blocking plate 40, and between the inner and outer cores 104 and 44 is contained catalyst material 78 forming a catalyst layer 42. Reference numeral 108 designates a substantially cylindrical lower heat-shielding plate, the lower end portion 110 of which is press-worked and welded to the lower end portion 112 of the outer core 44, while to the upper end portion 114 of the lower heat-shielding plate 108 is welded to the periphery 62 of a substantially hemispherical upper shielding plate 60 that is press-worked from shet metal. A support member 116 has an inner peripheral portion in a substantially cylindrical shape that is conformed to and welded along the outer circumference of the above-described lower heat-shielding plate 108, and having its outer peripheral portion in the shape of a flange 120 which is clamped between the bottom surface 58 of the upper casing 24 and the top surface 59 of the lower casing 28 to support the above-mentioned catalyst casing 32 and the upper and lower heat-shielding plates 60 and 108 within the manifold 30. No gasket is provided between the upper and lower casings.

In the catalytic converter constructed as described above, exhaust gas discharged from the respective cylinders 14 of the engine body 2 is directed into the exhaust manifold 30 through the branch pipes 22 corresponding to the respective cylinders 14 and the apertures 64 in the upper heat-shielding plate 60 corresponding to the respective branch pipes 22. Then it is passed from the outside of the outer core 44 through the catalyst layer 42 to the inside of the inner core 104, because the top end of the inner core 104 is closed by the blocking plate 102 and because the lower heat-shielding plate 108 is welded to the lower end portion 112 of the outer core 44. The exhaust gas is thus cleaned by the catalyst forming the catalyst layer 42, and is exhausted to the atmosphere through the exhaust port 26 and through an exhaust pipe and a muffler not shown. Accordingly, the catalytic converter apparatus according to the above-described preferred embodiment can achieve the same functions and effects as the first preferred embodiment.

Figure 9:
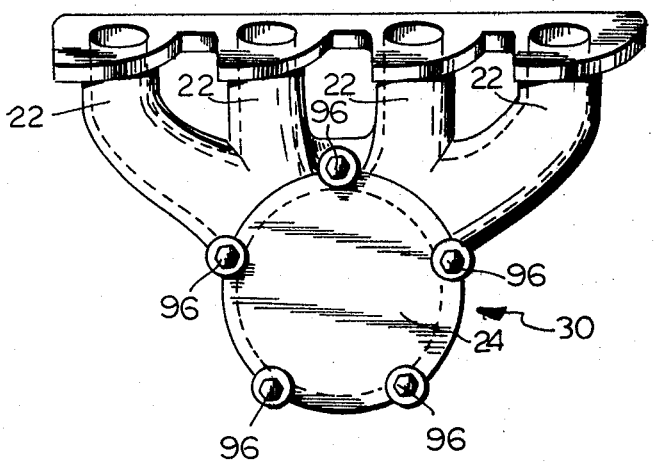
FIG. 9 is a plan view of a modification of the converter of the present invention.
Figure 10:
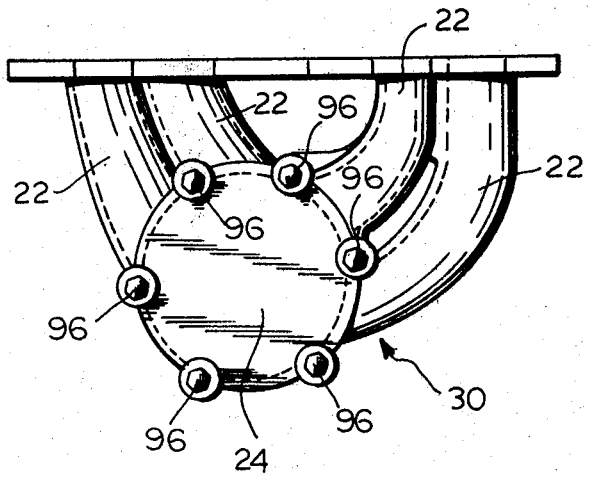
FIG. 10 is a plan view of another preferred embodiment of the converter of the present invention.

Other modifications of the exhaust manifold according to the present invention are shown in FIGS. 9 and 10. In the modification shown in FIG. 9, the bolts 96 inserted from above the upper casing 24 are disposed at equal intervals along the outer peripheral portion of the exhaust manifold 30 as as to equally divide the circumference into five parts, and the branch pipes 22 are arranged so that the branch pipes 22 for the front two cylinders are joined and those for the rear two cylinders are joined, and the respective joined pipes are connected to the exhaust manifold in the intervals between the bolts 96. In the modification shown in FIG. 10 the bolts 96 inserted from above the upper casing 24 are disposed at equal intervals along the outer peripheral portion of the exhaust manifold 30 so as to equally divide the circumference into six parts, and the exhaust ports for the front two cylinders of the engine body 2 are positioned close to each other, and the exhaust ports for the rear two cylinders are also positioned close to each other. The branch pipes 22 for the front two cylinders and the rear two cylinders are, respectively, positioned adjacent to each other. Even with the arrangements of the bolts 96 and the branch pipes 22 illustrated in FIGS. 9 and 10, the same functions and effects as in the above-described respective embodiments can be achieved.

What we claim is:

1. A catalytic converter apparatus for reducing pollutants from an engine having a plurality of cylinders, comprising an upper casing for mounting on the engine and having branch pipes extending to the engine and through which exhaust gas discharged from the respective cylinders in said engine is led, a lower casing connected to said upper casing for forming an exhaust manifold in cooperation with said upperr casing, said lower casing having a discharge port for said exhaust gas, a catalyst casing disposed within said exhaust manifold and having a support member extending therefrom and held between abutting surfaces of said upper and lower casing, said catalyst casing having a hollow substantially cylindrical inner core with a perforated cylindrical wall and an open upper end and a closed lower end, and an outer core having a perforated cylindrical wall and disposed coaxially with said inner core to define a space therebetween and having upper and lower end portions closing both the upper and lower ends of said space, and a catalyst layer in said space, said support member having an inner peripheral portion fixedly secured to the upper end of said outer core and an outer peripheral portion of the shape of a flat annular flange extending between the abutting surfaces between said upper and lower casings, and bolts inserted through said casings from above said upper casing for coupling said upper and lower casings to each other and clamping said support member therebetween.

2. A catalytic converter apparatus as claimed in claim 1, wherein the surface of the inner peripheral portion of the support member and the upper end portion of the outer core are joined and have a conical shape inclined in the radially outward and upward direction.

3. A catalytic converter apparatus as claimed in claim 1, wherein said lower end portion has a catalyst charging port therein and a plug threaded into said port, and the distance between the inner wall surface of the exhaust manifold and the outer end of the plug is smaller than the effective length of the threaded portion of said plug.

4. A catalytic converter apparatus as claimed in claim 1, further comprising a heat-shielding plate within said exhaust manifold and spaced at a predetermined distance from the inner wall surface of said exhaust manifold and integrally connected to said support member for being supported jointly with the catalyst casing by the portion thereof between the abutting surfaces between said upper and lower casings.

5. A catalytic converter apparatus as claimed in claim 4, wherein said heat-shielding plate is formed of sheet metal and has a substantially hemispherical upper portion and a lower portion divided longitudinally in the direction of exhaust gas flow into first and second lower heat-shielding plate halves, said support member having a cylindrical portion, the periphery of said upper heat-shielding portion being welded to said support member along the outer circumference thereof, said first and second lower heat-shielding plate halves being welded to each other and having their upper edges welded to the circumferential surface of the cylindrical section of said support member, whereby said upper and lower heat-shielding plate portions are supported jointly with said catalyst casing by the portion of said support member held between abutting surfaces of said upper and lower casings.

6. A catalytic converter apparatus as claimed in claim 1, wherein said bolts for coupling said upper and lower casings are disposed at an equal pitch along the outer circumference of said exhaust manifold.

7. A catalytic converter apparatus as claimed in claim 6, wherein said branch pipes through which the exhaust gas is led are independent and correspond to the respective cylinders in the engine, and said upper casing has independent openings in the portions between said bolts through which the respective branch pipes open into the exhaust manifold.

8. A catalytic converter apparatus as claimed in claim 7, wherein each pipe has a rib having a predetermined width and extending along the lower side of the pipe.

9. A catalytic converter apparatus for reducing pollutants from an engine having a plurality of cylinders, comprising an upper casing for mounting on the engine and having branch pipes extending to the engine and through which exhaust gas discharged from the respective cylinders in said engine is led, a lower casing connected to said upper casing for forming an exhaust manifold in cooperation with said upper casing, said lower casing having a discharge port for said exhaust gas, a catalyst casing disposed within said exhaust manifold and having a support member extending therefrom and held between abutting surfaces of said upper and lower casings, said catalyst casing having a hollow substantially cylindrical inner core with a perforated cylindrical wall and a closed upper end and an open lower end, and an outer core having a perforated cylindrical wall disposed coaxially with said inner core to define a space therebetween and having upper and lower end portions closing both the upper and lower ends of said space, and a catalyst layer in said space, said support member having an inner peripheral portion fixedly connected to the lower end of said outer core and an outer peripheral portion in the shape of a flat annular flange extending between the abutting surfaces between said upper and lower casings, and bolts inserted through said casings from above said upper casing for coupling said upper and lower casings to each other and clamping said support member therebetween.

10. A catalytic converter apparatus as claimed in claim 9, wherein said lower end portion has a catalyst charging port therein and a plug threaded into said port, and the distance between the inner wall surface of the exhaust manifold and the outer end of the plug is smaller than the effective length of the threaded portion of said plug.

11. A catalytic converter apparatus as claimed in claim 9, further comprising a heat-shielding plate within said exhaust manifold and spaced at a predetermined distance from the inner wall surface of said exhaust manifold and integrally connected to said support member for being supported jointly with the catalyst casing by the portion thereof between the abutting surfaces between said upper and lower casings.

12. A catalytic converter apparatus as claimed in claim 11, wherein said heat-shielding plate is formed of sheet metal and has a substantially hemispherical upper portion and a lower cylindrical portion, the periphery of said upper heat-shielding portion being welded to the upper end of said lower heat-shielding portion along the outer circumference thereof, said inner peripheral portion of said support member being welded to the outer periphery of said lower heat-shielding portion, and the inner periphery of the lower end of said lower heat-shielding portion being welded to said lower end of said outer core, whereby said upper and lower heat-shielding plate portions are supported jointly with said catalyst casing by the portion of said support member held between abutting surfaces of said upper and lower casings.

13. A catalytic converter apparatus as claimed in claim 9, wherein said bolts for coupling said upper and lower casings are disposed at an equal pitch along the outer circumference of said exhaust manifold.

14. A catalytic converter apparatus as claimed in claim 13, wherein said branch pipes through which the exhaust gas is led are independent and correspond to the respective cylinders in the engine, and said upper casing has independent openings in the portions between said bolts through which the respective branch pipes open into the exhaust manifold.

15. A catalytic converter apparatus as claimed in claim 14, wherein each pipe has a rib having a predetermined width and extending along the lower side of the pipe.

* * * * *